US008171583B1

(12) United States Patent
Hooker et al.

(10) Patent No.: US 8,171,583 B1
(45) Date of Patent: May 8, 2012

(54) HOSPITAL BED WITH AN INTEGRAL BED PAN

(76) Inventors: Josephine Hooker, Grand Prairie, TX (US); Marcus Small, Grand Prairie, TX (US); Joell McKay, Grand Prairie, TX (US)

( * ) Notice: Subject to any disclaimer, the term of this patent is extended or adjusted under 35 U.S.C. 154(b) by 166 days.

(21) Appl. No.: 12/604,948

(22) Filed: Oct. 23, 2009

Related U.S. Application Data

(60) Provisional application No. 61/196,992, filed on Oct. 23, 2008.

(51) Int. Cl.
*A61G 7/02* (2006.01)

(52) U.S. Cl. ..... 5/604; 5/605; 5/695

(58) Field of Classification Search ..... 5/604, 605, 5/617, 618, 695
See application file for complete search history.

(56) References Cited

U.S. PATENT DOCUMENTS

| | | | |
|---|---|---|---|
| 972,100 | A | 10/1910 | Crandall |
| 1,636,705 | A | 7/1927 | Prettenthaler |
| 4,091,480 | A | 5/1978 | Oxenburg |
| 4,590,632 | A | 5/1986 | Meyer |
| 4,843,665 | A | 7/1989 | Cockel et al. |
| 5,539,941 | A | 7/1996 | Fuller |
| D375,849 | S | 11/1996 | Conrad |
| 5,685,034 | A | 11/1997 | Kleer et al. |

*Primary Examiner* — Robert G Santos
*Assistant Examiner* — Brittany Wilson
(74) *Attorney, Agent, or Firm* — Montgomery Patent & Design, LLC; Robert C. Montgomery; Joseph T. Yaksich

(57) ABSTRACT

A mattress apparatus that combines the functionality of a hospital bed with that of a bedpan is herein disclosed. A bedpan assembly is provided to temporarily replace a slidable mattress section in the middle of the mattress area. In use, a person confined to a bed can use the bedpan without exiting the bed, thereby avoiding undue physical stress. The bedpan is inserted under a buttock area for normal use using an integrated track system, and slid out being coincidentally replaced by the slidable mattress section, to return the bed to its original condition. The bedpan can be removed, emptied, and cleaned by the care-giver without disturbing the patient.

18 Claims, 3 Drawing Sheets

HOSPITAL BED WITH AN INTEGRAL BED PAN

RELATED APPLICATIONS

The present invention was first described in and claims the benefit of U.S. Provisional Application No. 61/196,992, filed Oct. 23, 2008, the entire disclosures of which are incorporated herein by reference.

FIELD OF THE INVENTION

The present invention relates generally to hospital beds, and in particular, to an adjustable non-ambulatory patient bed with an integral bed pan assembly for allowing simple use of a toilet for non-ambulatory patients.

BACKGROUND OF THE INVENTION

An ongoing issue in the medical field is providing non-ambulatory or bedridden hospital patients with basic amenities and conveniences in a simple and comfortable manner. Among the most difficult of these tasks is providing a non-ambulatory patient with access to lavatory facilities and a simple method for the sanitary disposal of waste products. Traditional solutions such as bed pans are unsanitary, uncomfortable, and unsavory by modern standards. Many such approaches lead to both mental and physical discomfort for both the patients and those attending to them.

Various attempts have been made to provide bathroom capabilities to non-ambulatory and bedridden patients. Examples of these attempts can be seen by reference to several U.S. patents. U.S. Pat. No. 972,100, issued in the name of Crandall, describes a bed for invalids. The Crandall bed includes an aperture in the proximity of the patient's behind to allow for bathroom capabilities.

U.S. Pat. No. 4,590,632, issued in the name of Meyer, describes a mattress for accommodating a bedpan or therapeutic device. The Meyer apparatus allows temporary insertion of various devices in the proximity of the patient.

U.S. Pat. No. 5,539,941, issued in the name of Fuller, describes a sling system for assisting a non-ambulatory patient. The Fuller apparatus includes a bath water and waste water cart.

Additionally, ornamental designs for a hospital bed exist, particularly U.S. Pat. No. D 375,849. However, none of these designs are similar to the present invention.

While these devices fulfill their respective, particular objectives, each of these references suffer from one (1) or more of the aforementioned disadvantages. Many such apparatuses such as beside commodes can be difficult or impossible for non-ambulatory patients to use. Also, many such apparatuses are uncomfortable and complicated for a patient to use. Furthermore, many such apparatuses are time consuming, complex, and unwieldy for those assisting patients to set up or clean. Accordingly, there exists a need for a means by which non-ambulatory patients can enjoy restroom capabilities and a means by which those assisting patients can assist and clean up for such patients without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means by which non-ambulatory patients can enjoy restroom capabilities and a means by which those assisting patients can assist and clean up for such patients in a simple and respectful manner. Thus, the object of the present invention is to solve the aforementioned disadvantages and provide for this need.

To achieve the above objectives, it is an object of the present invention to comprise a split mattress apparatus, which further comprises an upper mattress section, a lower mattress section, a center mattress insert, and a bedpan insert. The apparatus enables temporary attachment of the bedpan insert to the mattress insert to quickly slide the bedpan insert beneath a bed occupant for the purpose of relieving themselves with minimal intrusion.

Another object of the present invention is to comprise upper and lower mattress sections similar in material, construction, and function to common commercially available adjustable bed mattresses. The apparatus may be used in conjunction with a variety of existing common adjustable bed frames.

Yet still another object of the present invention is to join the mattress sections with a connecting panel, which is constructed of a smooth flexible extruded plastic material and permanently attached to the underside surface of each mattress section. The connecting panel extends along a horizontal plane between the sections and provides a surface upon which the mattress insert and bedpan insert are to slide across and rest upon during normal use.

Yet still another object of the present invention is to comprise the upper mattress section of a first cushion layer, a first support structure, and a hinge. The first cushion layer is made of common cushioning materials such as fabric, batting, foam rubber padding, or the like and covered in an expected manner using vinyl, fabric, or the like.

Yet still another object of the present invention is to comprise the first support structure of an open top, five-sided structure which provides planar and edge support to the first cushion layer contained and seated within. The structure further comprises an integral channel-shaped outside track section along a proximal vertical surface which provides interlocking lateral guidance to the mattress and bedpan inserts via inside track sections.

Yet still another object of the present invention is to comprise the hinge of a single axis angulation of the upper mattress at an approximate waist location of an occupant. This allows the user to obtain an elevated seated posture if desired.

Yet still another object of the present invention is to comprise the lower mattress section of a second cushion layer and a second support structure of similar material, construction, and function as the upper mattress section. In like manner as the upper mattress section, the lower mattress section provides interlocking lateral guidance to the mattress and bedpan inserts, thereby slidingly entrapping the insert between the two (2) sections.

Yet still another object of the present invention is to provide an open intermediate region spanned by the connection panel which is suitable to slidingly receive the mattress and bedpan inserts, having a width equivalent to the mattress sections, and approximately eighteen (18) to twenty four (24) inches long. The connection panel is positioned between the mattress sections so as to align with a buttock region of a bed occupant when lying on the apparatus.

Yet still another object of the present invention is to comprise first and second interconnecting features to allow the mattress and bedpan inserts to be temporarily joined together. This allows a caregiver to motion both inserts coincidentally between the mattress sections, using a single "U"-shaped handle which is provided on the bedpan insert.

Yet still another object of the present invention is to comprise a pair of outside track sections to provide guided lateral motion of the mattress and bedpan inserts via corresponding inside track sections. The outside track sections are located on facing end portions of the mattress sections and are integrally formed into vertical portions of the first and second support structures.

Yet still another object of the present invention is to further comprise each outside track section of a linear rectangular-shaped protruding channel member sized so as to be slidingly received within the corresponding slot-shaped first and second inside track sections. The track sections may utilize other interlocking mechanisms or designs common in the industry which provide smooth lateral motioning of the mattress and bedpan inserts.

Yet still another object of the present invention is to construct the mattress insert in a similar manner to the mattress sections, comprising a mattress insert cushion layer and a mattress insert support layer. The mattress insert further comprises a pair of first inside track sections on opposite outer surfaces, arranged in a parallel manner so as to align and slidingly interconnect with the outside track sections of the mattress sections.

Yet still another object of the present invention is to comprise the bedpan insert of a rectangle-shaped inner cavity which provides stable positioning of a bedpan lid assembly via a lid support feature and which receives the bodily waste from the occupant. The bed insert is constructed of a lightweight rigid plastic material.

Yet still another object of the present invention is to comprise the lid support feature of a step or ledge-shaped feature positioned slightly below a top edge of the bedpan insert. The lid support feature extends along three side portions to allow sliding removal of the bedpan lid assembly in a lateral direction.

Yet still another object of the present invention is to comprise the bedpan insert of a pair of second inside track sections on lower opposing outside vertical side walls which are aligned with and slidably attaching to the outside track sections.

Yet still another object of the present invention is to comprise the bedpan insert of a handle on an outside vertical wall surface and positioned opposite the second interconnecting fixture. The handle provides a means to grip the bedpan insert.

Yet still another object of the present invention is to comprise the bedpan lid assembly of a seat, a base, and a center opening which are preferably constructed of antimicrobial plastic materials capable of being easily washed and disinfected. The seat is similar to common bedpans providing a raised ergonomic seating surface.

Yet still another object of the present invention is for the seat to frame the center opening of the bedpan lid assembly, thereby providing passage of bodily waste from the occupant to the internal cavity. The seat is integrally molded into the base.

Yet still another object of the present invention is to comprise the base of a shallow flat rectangular cover extending outwardly and having downturned edge portions. The base further comprises perimeter dimensions which allow sliding vertical insertion into the open top portion of the bedpan insert being seated upon the lid support feature.

Yet still another object of the present invention is to comprise the internal cavity portion of the bedpan insert of sufficient internal volume for containing an amount of bodily waste from a non-ambulatory bed occupant. The inner cavity portion may also be used as temporary storage for various care giving materials such as gloves, cleansers, and the like.

Yet still another object of the present invention is to comprise interconnecting fixtures of integrally molded round-headed posts and receiving keyhole-type apertures, or other common coupling devices, which act to maintain the mattress insert and the bedpan insert in a coupled parallel orientation with respect to one (1) another. The interconnecting fixtures are located on mating parallel faces of the inserts which when coupled allow any linear movement of the bedpan insert to manipulate the position of the mattress insert.

Yet still another object of the present invention is to provide a method of utilizing the device that provides a unique means of providing a non-ambulatory patient with ergonomic and simple toilet capabilities, and caregivers with a simple, quick, and easy method of providing, interchanging, and cleaning bedpan facilities for a patient.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | hospital bed with an integral bedpan |
| 15 | upper mattress section |
| 16 | first cushion layer |
| 17 | first support structure |
| 18 | hinge |
| 20 | lower mattress section |
| 22 | connecting panel |
| 24 | outside track section |
| 28 | second cushion layer |
| 29 | second support structure |
| 30 | mattress insert |
| 32 | first inside track section |
| 36 | mattress insert cushion layer |
| 38 | mattress insert support layer |
| 40 | bedpan insert |
| 41 | internal cavity |
| 42 | second inside track section |
| 46 | handle |
| 48 | lid support feature |
| 50 | bedpan lid assembly |
| 52 | seat |
| 54 | base |
| 56 | center opening |
| 74 | first interconnecting fixture |
| 76 | second interconnecting fixture |
| 100 | bed frame |
| 110 | bed occupant |

DETAILED DESCRIPTION OF THE PREFERRED EMBODIMENT

Figure 1:
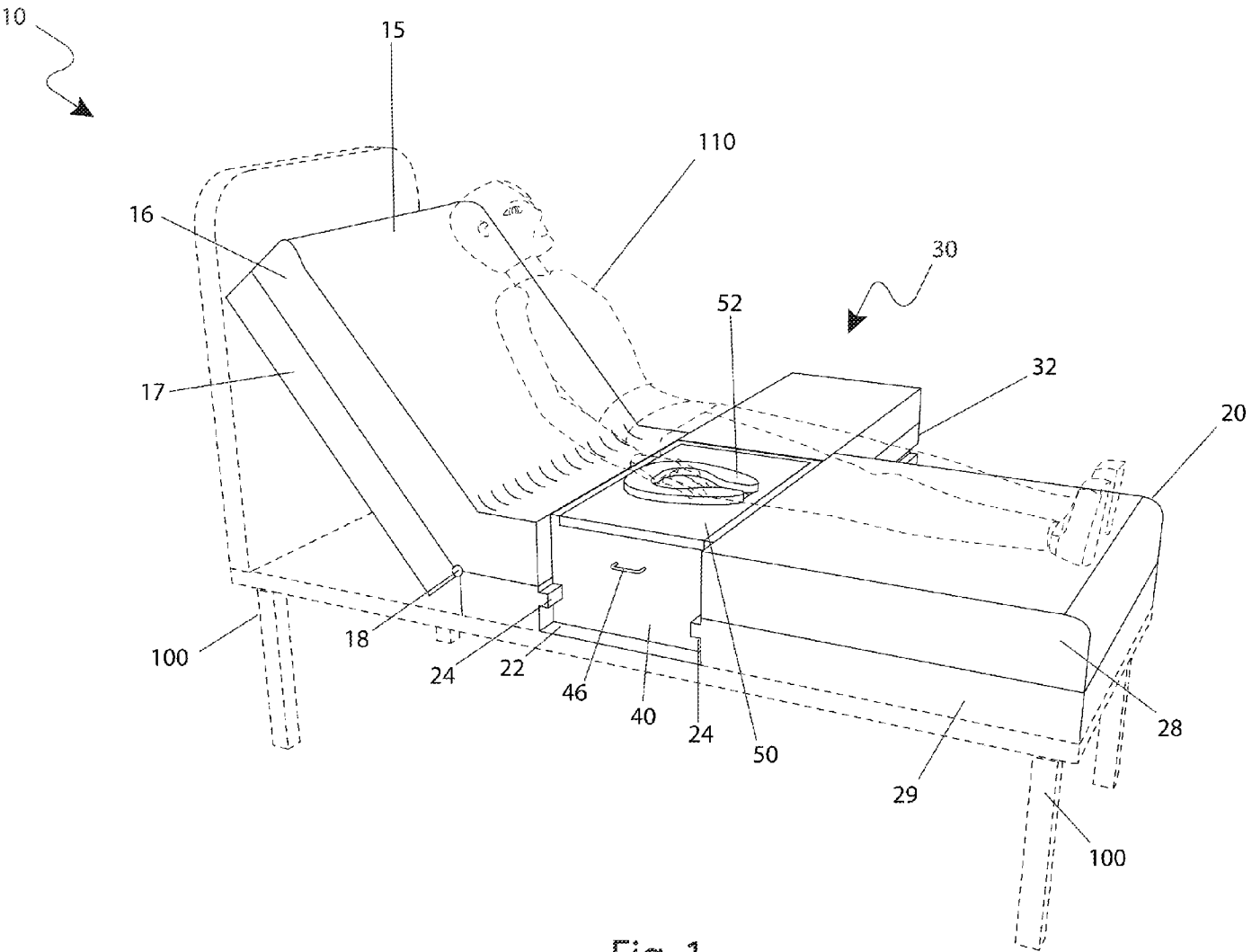
FIG. 1 is a side perspective view of a hospital bed with an integral bedpan 10, according to a preferred embodiment of the present invention.
Figure 2:
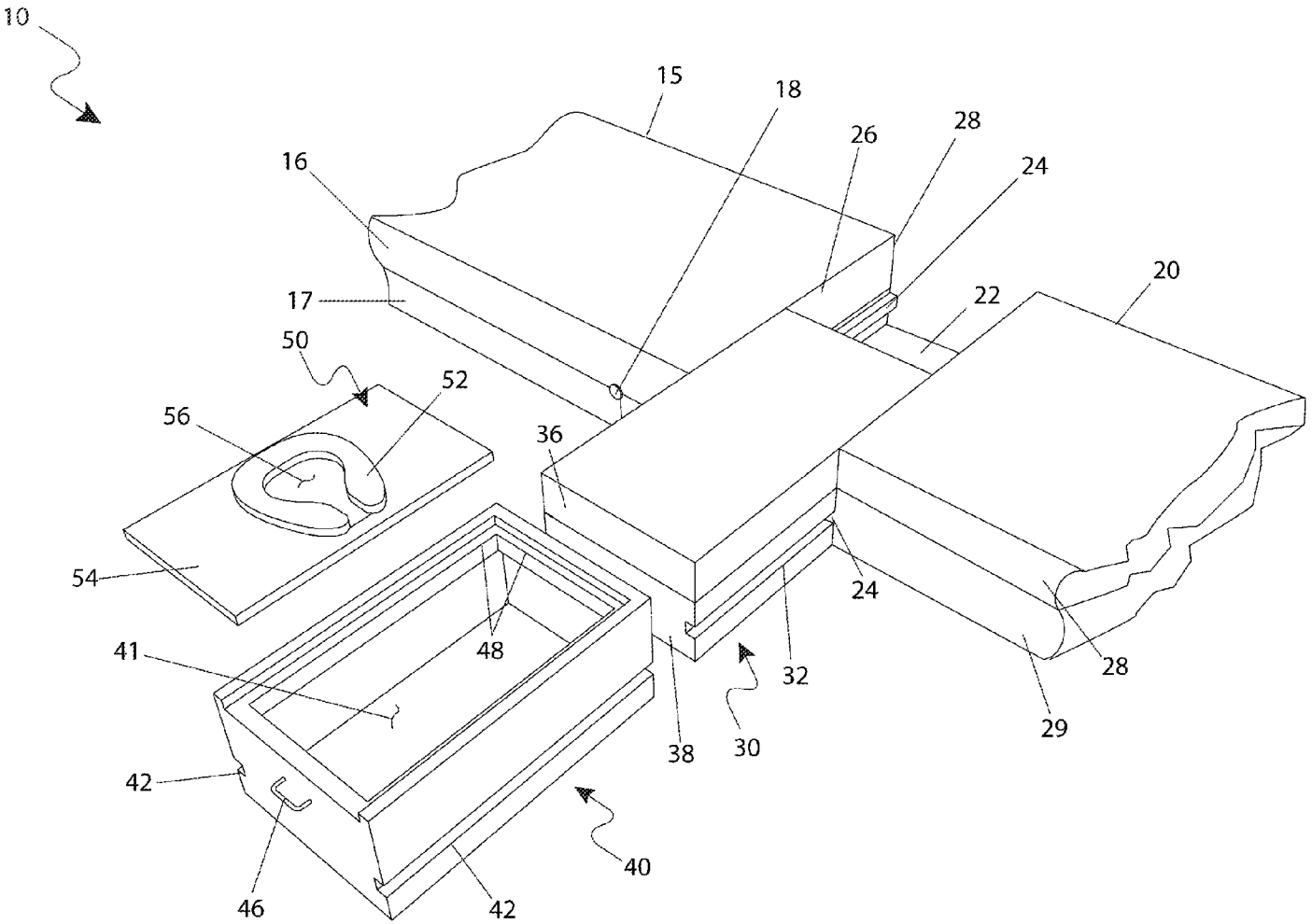
FIG. 2 is a detailed view of a hospital bed with an integral bedpan 10 depicting a slidable mattress insert 30, a bedpan insert 40, and a bedpan lid assembly 50, according to a preferred embodiment of the present invention; and, FIG. 3 is a close-up view of interconnecting portions 74, 76 of the mattress 30 and bedpan 40 insert portions, according to a preferred embodiment of the present invention.
Figure 3:
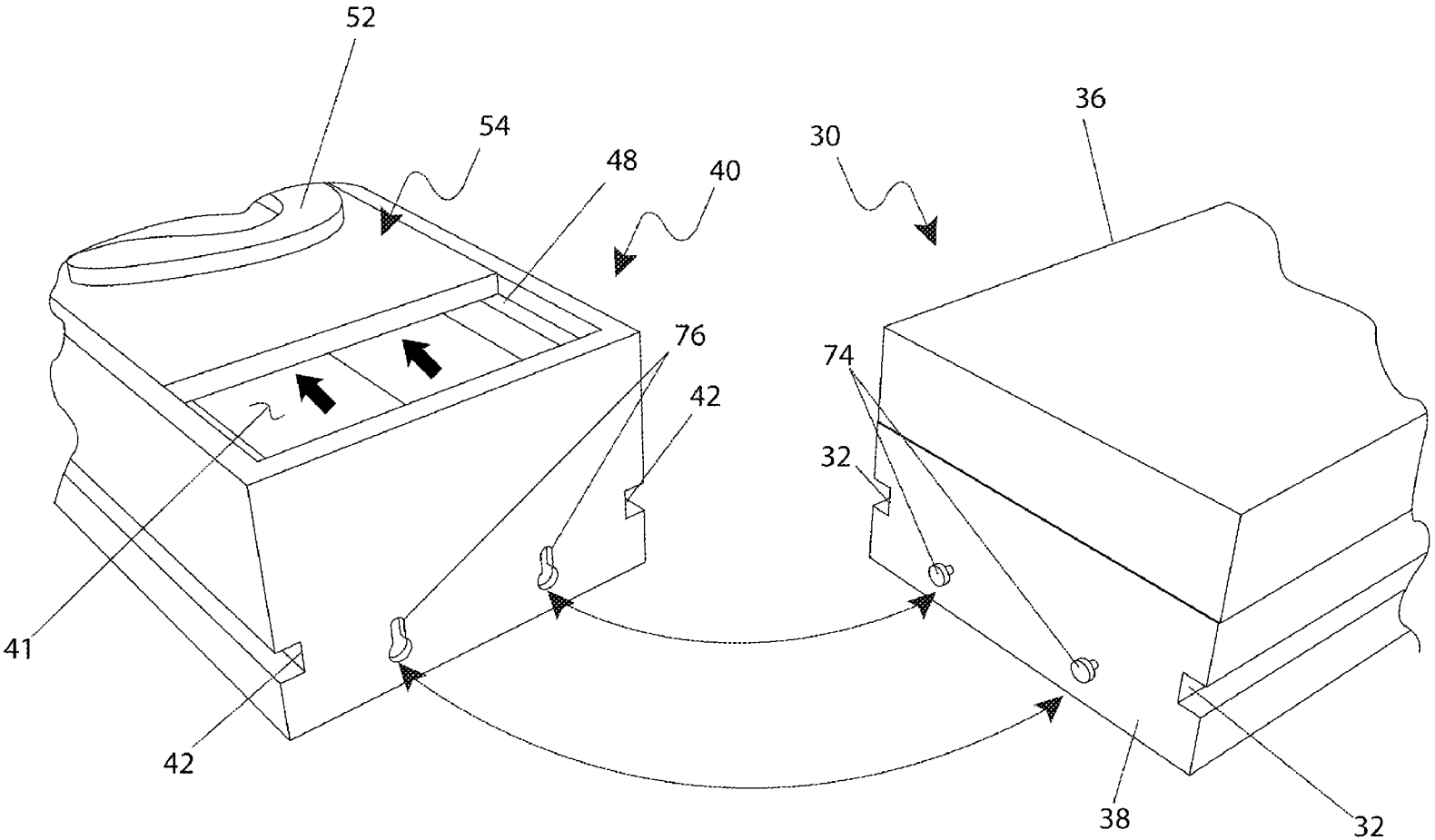

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hospital bed with an integral bedpan (herein described as the "apparatus") 10, which provides a means for a non-ambulatory bed occupant 110 to relieve theirself with a minimal amount of physical stress and overall movement. The apparatus 10 comprises a split mattress design comprising an upper mattress section 15 and a lower mattress section 20 for adjustable hospital bed frames 100. Said mattress sections 15, 20 further provide a means to slidingly install a center mattress insert 30 therebetween, which may be conveniently replaced by a bedpan insert 40 as needed. The apparatus 10 enables temporary attachment of the bedpan insert 40 thereto the mattress insert 30, thereby allowing the joined insert portions 30, 40 to slide laterally to quickly position the bedpan insert 40 beneath the bed occupant 110 for the purpose of relieving theirself with minimal intrusion.

Referring now to FIG. 1, a side perspective view of the apparatus 10, according to the preferred embodiment of the present invention, is disclosed. The apparatus 10 comprises upper 15 and lower 20 mattress sections being similar in materials, construction, and function to other common commercially available adjustable bed mattresses with particular enhancements, including laterally slidable and removable intermediate mattress 30 and bedpan 40 inserts. The apparatus 10 may be used in conjunction therewith a variety of existing common adjustable bed frames 100. Said mattress sections 15, 20 are joined by a connecting panel 22. The connecting panel 22 is preferably made of a smooth flexible extruded plastic material which is permanently attached thereto the underside surface of each mattress section 15, 20 and extending therebetween along a horizontal plane. The connecting panel 22 further provides a surface upon which the mattress insert 30 and bedpan insert 40 are to slide across and rest thereupon during normal use.

The upper mattress section 15 further comprises a first cushion layer 16, a first support structure 17, and a hinge 18. The first cushion layer 16 is envisioned to be made of common cushioning materials such as fabric, natural or synthetic batting, foam rubber padding, and the like, being covered in an expected manner using vinyl, fabric, leather, or equivalent materials and being introduced in a variety of colors and patterns. The first support structure 17 provides an open-topped, five (5) sided structure made preferably of a semi-rigid plastic material, thereby providing planar and edge support thereto the first cushion layer 16 contained and seated therewithin. The first support structure 17 further comprises an integral channel-shaped outside track section 24 located therealong a proximal vertical surface thereof which provides interlocking lateral guidance thereto the mattress 30 and bedpan 40 inserts via a first inside track section 32 and a second inside track section 42, respectively (see FIGS. 2 and 3).

The hinge 18 comprises single axis angulation of the upper mattress section 15 thereat an approximate waist location of the occupant 110, thereby obtaining an elevated seated posture of the occupant 110 if desired.

The lower mattress section 20 comprises a second cushion layer 28 and a second support structure 29 which comprise similar materials, construction, and function as the aforementioned first cushion layer 16 and first support structure 17 portions of the upper mattress section 15. In like manner as the upper mattress section 15, the lower mattress section 20 provides interlocking lateral guidance thereto the mattress 30 and bedpan 40 inserts, thereby slidingly entrapping said inserts 30, 40 therebetween.

The mattress 30 and bedpan 40 inserts may be temporarily joined theretogether via a first interconnecting feature 74 and a second interconnecting feature 76 (see FIG. 3), thereby allowing a caregiver to motion both inserts 30, 40 coincidentally horizontally between said mattress sections 15, 20 using a single "U"-shaped handle 46.

The upper 15 and lower 20 mattress sections provide an open intermediate region being spanned thereby the connection panel 22 being suitable to slidingly receive the mattress 30 and bedpan 40 inserts having a width equivalent to said mattress sections 15, 20 and approximately eighteen (18) to twenty-four (24) inches long. The connection panel 22 is to be positioned therebetween said mattress sections 15, 20 so as to align therewith a buttock region of a bed occupant 110 when laying thereon the apparatus 10.

Referring now to FIG. 2, a detailed view of the apparatus 10 depicting the mattress insert 30, the bedpan insert 40, and the bedpan lid assembly 50, according to the preferred embodiment of the present invention, is disclosed. The apparatus 10 further comprises a pair of outside track sections 24 which provide guided lateral motioning of the aforementioned mattress 30 and bedpan 40 inserts via corresponding respective first 32 and second 42 inside track sections. Said outside track sections 24 are located thereon facing end portions of the upper 15 and lower 20 mattress sections being integrally formed thereinto vertical portions of the first 17 and second 29 support structures, respectively. Each outside track section 24 comprises a linear rectangular-shaped protruding channel member specifically sized so as to be slidingly received therewithin the corresponding slot-shaped first 32 and second 42 inside track sections, thereby providing smooth lateral motioning thereof said mattress 30 and bedpan 40 inserts. However, it is understood that said outside track sections 24 and corresponding first 32 and second 42 inside track sections may also utilize various other interlocking mechanisms and designs such as interlocking "T"-shaped profiles, angular "dove-tail" designs, rotating wheels and tracks, or other means common in the industry, and as such should not be interpreted as a limiting factor of the apparatus 10. The mattress 30 and bedpan 40 inserts are envisioned to traverse the connecting panel 22 and may be positioned in any location along the linear outside track sections 24.

The mattress insert 30 comprises similar construction as the aforementioned upper 15 and lower 20 mattress sections comprising a mattress insert cushion layer 36 and a mattress insert support layer 38 which provide similar construction, materials, and functions as corresponding portions of the previously described upper 15 and lower 20 mattress sections. The mattress insert 30 comprises a pair of first inside track sections 32 located thereupon opposite outer surfaces, being arranged in a parallel manner so as to align and slidingly interconnect therewith the outside track sections 24 of the mattress sections 15, 20.

The bedpan insert 40 is envisioned being made of a lightweight rigid plastic material and comprises a rectangle-shaped inner cavity 41. The inner cavity 41 provides stable positioning of a bedpan lid assembly 50 therealong upper edge portions via an integrally-molded lid support feature 48 and also receives the bodily waste from the occupant 110. The lid support feature 48 comprises a step or ledge-shaped feature positioned slightly below a top edge of said bedpan insert 40 which extends along three (3) side portions, thereby allowing sliding removal of said bedpan lid assembly 50 therein a lateral direction. The bedpan insert 40 further comprises a pair of second inside track sections 42 located on lower opposing outside vertical side walls of the bedpan insert 40 being aligned therewith and slidably attaching thereto the aforementioned outside track sections 24.

The bedpan insert 40 also comprises a handle 46 located upon an outside vertical wall surface and positioned opposite the second interconnecting fixture 76 (see FIG. 3), and is envisioned to provide a means to grip said bedpan insert 40.

The bedpan lid assembly 50 further comprises a seat 52, a base 54, and a center opening 56. Said bedpan lid assembly portions 52, 54 are preferably made of anti-microbial plastic materials capable of being easily washed and disinfected. The seat portion 52 is to be similar in form to other common bedpans providing a raised ergonomic seating surface providing comfort thereto a buttock area of a bed occupant 110. The seat 52 frames the center opening 56, thereby providing passage of bodily waste from said occupant 110 to the internal cavity 41. The seat 52 is to be integrally-molded thereinto the base 54. Said base 54 comprises a shallow flat rectangular cover extending outwardly and having down-turned edge portions. The base 54 comprises perimeter dimensions which allow sliding vertical insertion thereinto the open top portion of the bedpan insert 40 subsequently being seated thereupon the previously described lid support feature 48. The internal cavity portion 41 of the bedpan insert 40 is to comprise sufficient internal volume for containing an amount of bodily waste therefrom said non-ambulatory bed occupant 110. During normal use, the bedpan lid assembly 50 is placed thereon the lid support feature 48 of the bedpan insert 40 by removably resting the base 54 thereupon, being easily slid therefrom said lid support feature 48 in a side-ways direction, and removed for emptying and cleaning purposes. The inner compartment 41 is also envisioned to be utilized as a temporary storage means thereto various care-giving materials such as rubber gloves, toilet tissue, cleansers, and the like.

Referring now to FIG. 3, a close-up view of interconnecting portions 74, 76 of respective mattress 30 and bedpan 40 insert portions, according to a preferred embodiment of the present invention, is disclosed. The mattress section 30 further comprises a first interconnecting fixture 74 which provides a means of temporarily coupling said mattress section 30 thereto a complementing second interconnecting fixture portion 76 of the bedpan insert 40. The first 74 and second 76 interconnecting fixtures are located thereupon mating parallel faces of the respective inserts 30, 40 which when coupled theretogether, any linear movement of the bedpan insert 40 will manipulate the position of the slidable mattress insert 30. The interconnecting fixtures 74, 76 are illustrated here comprising integrally-molded round-headed posts 74 and receiving keyhole-type apertures 76 which act to maintain the mattress insert 30 and the bedpan insert 40 in a coupled parallel orientation with respect to one another. However, it is understood that the apparatus 10 may be introduced utilizing a variety of other common removably coupling devices, hardware, and fixtures of various designs, which provide equal benefit and as such should not be interpreted as a limiting factor of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 through 3.

The method of utilizing the apparatus 10 may be achieved by performing the following steps; mounting the upper 15 and lower 20 mattress sections, therewith the attached connecting panel 22, thereto an existing hospital bed 100; installing the mattress insert 30 therebetween the upper 15 and lower 20 mattress sections by aligning and inserting the first inside track sections 32 thereonto the outside track sections 24; allowing an occupant 110 to enter, lay upon, and occupy the apparatus 10 in a normal manner; allowing said occupant 110 to relieve him or herself, with the assistance of a care-giver as necessary, by retrieving the bedpan insert 40 and the bedpan lid assembly 50; placing the bedpan lid assembly 50 thereupon the lid support features 48 of the bedpan insert 40; coupling the bedpan insert 40 thereto the mattress insert 30 by engaging and securing the first 74 and second 76 interconnecting fixtures thereto each other; slightly elevating the buttock portions of the occupant 110 off the mattress insert 30; grasping the handle 46 and pushing the bedpan insert 40 thereonto the connecting panel 22, thereby positionally replacing the mattress insert 30 therewith the bedpan insert 40; resting the buttocks of the occupant 110 thereon the seat 52 portion of the bedpan lid assembly 50; allowing the bed occupant 110 to relieving him or herself as normal; slightly raising the buttocks of the occupant 10 off of the seat 52; grasping the handle 46 and pulling the bedpan insert 40 outwardly therefrom the connecting panel 22, thereby being positionally replaced with the mattress insert 30; allowing the bed occupant 110 to relax and lay thereon the top surface of the mattress insert 30 and mattress sections 15, 20 in a normal manner; removing the bedpan insert 40 by uncoupling the interconnecting fixtures 74, 76; removing the bedpan lid assembly 50 therefrom the bedpan assembly 40 by lifting and/or sliding said bedpan lid assembly 50 laterally therefrom the lid support feature 48; emptying, cleaning, and disinfecting the bedpan lid assembly 50 and bedpan insert 40, as desired; storing the bedpan insert 40 and the bedpan lid assembly 50 until needed; and, enabling an occupant 110 to relieve him or herself with a minimal amount of physical stress and overall movement using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A bed comprising a removably inserted bedpan, comprising:

said bed comprising a mattress split into an upper mattress section and a lower mattress section and defining an open intermediate region between, said upper mattress section further comprising:

a first cushion layer;

a first support structure comprising an open top, five-sided structure providing a planar and an edge support means to said first cushion layer contained and seated within;

a first integral channel-shaped outside track section along a proximal vertical surface of said first support structure facing said open intermediate region providing an interlocking lateral guidance means to said upper mattress section and said bedpan; and, a hinge, comprising a single axis angulation of said upper mattress section at a waist location of said user;

said bedpan insertingly placed within said open intermediate region, said bedpan comprising a width matching said bed and secured thereto with a pair of fastening means; and, a connecting panel for joining said upper mattress section thereto said lower mattress section, said connection panel further comprises a smooth flexible body permanently attached to an underside surface of said upper mattress section and said lower mattress section;

wherein said bedpan allows users to utilize said bedpan while remaining in said bed;

wherein said bedpan collects bodily waste therein;

wherein said bedpan when inserted in said bed provides a means to minimize mess when handling said bedpan;

wherein a caretaker can remove said bedpan from said bed to remove said bodily waste from said bedpan and for sanitizing said bedpan; and, wherein said connecting panel extends along a horizontal plane between said upper mattress section and said lower mattress section to provide a surface upon which said bedpan is inserted in and rests upon.

2. The bed of claim 1, wherein said open intermediate region spanned by said connection panel comprises a width of approximately eighteen to twenty four inches long and positioned so as to align with a buttock region of said user.

3. The bed of claim 1, wherein said lower mattress section further comprises:

a second cushion layer;

a second support structure comprising an open top, five-sided structure providing a planar and an edge support means to said second cushion layer contained and seated within; and, a second integral channel-shaped outside track section along a proximal vertical surface of said second support structure facing said open intermediate region providing an interlocking lateral guidance means to said lower mattress section and said bedpan.

4. The bed of claim 3, wherein said bedpan further comprises:

a bedpan insert body having a rectangle-shaped inner cavity;

a bedpan lid assembly stably supported by said bedpan insert body via a lid support feature, comprising a base cover extending outwardly and having downturned edge portions;

a seat frame a center opening of said bedpan lid assembly;

a pair of bedpan inside track sections on lower opposing outside vertical side walls of said bedpan insert body; and, a handle on an outside vertical wall surface of said bedpan insert body;

wherein said cavity provides a capacity to retain bodily waste therein; and, wherein said base cover is slidingly inserted an open top portion of said bedpan insert body being seated upon said lid support feature.

5. The bed of claim 4, wherein said lid support feature further comprises a step positioned slightly below a top edge of said bedpan insert body extending along three side portions to allow sliding removal of said bedpan lid assembly in a lateral direction.

6. The bed of claim 5, wherein said first outside track section and said second outside track section each comprise a linear rectangular-shaped protruding channel member sized so as to be slidingly received within said pair of inside track sections.

7. The bed of claim 3, wherein said bedpan comprises antimicrobial plastic materials and providing a raised ergonomic seating surface.

8. The bed of claim 3, further comprising a center mattress insert removably inserted in between said upper mattress section and said lower mattress section when use of said bedpan is not necessary.

9. The bed of claim 8, wherein said center mattress insert further comprises:

a center mattress insert cushion layer;

a center mattress insert support layer; and, a pair of center inside track sections on lower opposing outside vertical side walls of said center mattress insert.

10. The bed of claim 9, further comprising a pair of interconnecting fixtures to couple said bedpan and said center mattress insert and the bedpan insert in a coupled parallel orientation.

11. A bed comprising a removably inserted bedpan, comprising:

said bed comprising an upper mattress section and a lower mattress section and defining an open intermediate region between, further comprising:

a first cushion layer;

a first support structure comprising an open top, five-sided structure providing a planar and an edge support means to said first cushion layer contained and seated within;

a first integral channel-shaped outside track section along a proximal vertical surface of said first support structure facing said open intermediate region providing an interlocking lateral guidance means to said upper mattress section and said bedpan;

a hinge, comprising a single axis angulation of said upper mattress section at an waist location of said user;

a second cushion layer;

a second support structure comprising an open top, five-sided structure providing a planar and an edge support means to said second cushion layer contained and seated within; and, a second integral channel-shaped outside track section along a proximal vertical surface of said second support structure facing said open intermediate region providing an interlocking lateral guidance means to said lower mattress section and said bedpan;

said bedpan insertingly placed within said open intermediate region, said bedpan comprising a width matching said bed and secured thereto with a pair of fastening means;

a connecting panel for joining said upper mattress section thereto said lower mattress section, said connection panel further comprises a smooth flexible body permanently attached to an underside surface of said upper mattress section and said lower mattress section;

wherein said bedpan allows users to utilize said bedpan while remaining in said bed;

wherein said bedpan collects bodily waste therein;

wherein said bedpan when inserted in said bed provides a means to minimize mess when handling said bedpan;

wherein said connecting panel extends along a horizontal plane between said upper mattress section and said lower mattress section to provide a surface upon which said bedpan is inserted in and rests upon; and, wherein a caretaker can remove said bedpan from said bed to remove said bodily waste from said bedpan and for sanitizing said bedpan.

12. The bed of claim 11, wherein said bedpan further comprises:

a bedpan insert body having a rectangle-shaped inner cavity;

a bedpan lid assembly stably supported by said bedpan insert body via a lid support feature, comprising a base cover extending outwardly and having downturned edge portions;

a seat frame a center opening of said bedpan lid assembly;

a pair of bedpan inside track sections on lower opposing outside vertical side walls of said bedpan insert body; and, a handle on an outside vertical wall surface of said bedpan insert body;

wherein said cavity provides a capacity to retain bodily waste therein; and, wherein said base cover is slidingly inserted an open top portion of said bedpan insert body being seated upon said lid support feature.

13. The bed of claim 12, wherein said lid support feature further comprises a step positioned slightly below a top edge of said bedpan insert body extending along three side portions to allow sliding removal of said bedpan lid assembly in a lateral direction.

14. The bed of claim 12, wherein said first outside track section and said second outside track section each comprise a linear rectangular-shaped protruding channel member sized so as to be slidingly received within said pair of inside track sections.

15. The bed of claim 12, wherein said bedpan comprises antimicrobial plastic materials and providing a raised ergonomic seating surface.

16. The bed of claim 12, further comprising a center mattress insert removably inserted in between said upper mattress section and said lower mattress section when use of said bedpan is not necessary.

17. The bed of claim 16, wherein said center mattress insert further comprises:

a center mattress insert cushion layer;

a center mattress insert support layer; and, a pair of center inside track sections on lower opposing outside vertical side walls of said center mattress insert.

18. The bed of claim 17, further comprising a pair of interconnecting fixtures to couple said bedpan and said center mattress insert and the bedpan insert in a coupled parallel orientation.

* * * * *